United States Patent [19]

Hogan

[11] Patent Number: 4,961,766

[45] Date of Patent: Oct. 9, 1990

[54] ADJUSTABLE VENTILATION, AIR PURIFICATION AND STORAGE APPARATUS FOR MODULAR OFFICE FURNITURE

[76] Inventor: James S. Hogan, P.O. Box 1056, Gulf Breeze, Fla. 32561

[21] Appl. No.: 396,037

[22] Filed: Aug. 21, 1989

[51] Int. Cl.[5] ..... B01D 50/00

[52] U.S. Cl. ..... 55/385.2; 55/DIG. 18; 98/115.3

[58] Field of Search ..... 55/385.2, DIG. 18, DIG. 29; 98/115.3

[56] References Cited

U.S. PATENT DOCUMENTS

| | | | |
|---|---|---|---|
| 2,285,346 | 6/1942 | Moncrief | 98/29 |
| 2,795,471 | 6/1957 | Reineman | 312/194 |
| 3,364,838 | 1/1968 | Bradley | 98/33 |
| 3,604,333 | 9/1971 | Nelson | 98/115.3 |
| 4,014,598 | 3/1977 | Stalley et al. | 312/236 |
| 4,023,529 | 5/1977 | Landy | 55/385.2 |
| 4,094,256 | 6/1978 | Holper et al. | 108/50 |
| 4,378,727 | 4/1983 | Doss | 98/33 R |
| 4,399,740 | 8/1983 | Zboralski | 98/115.3 |
| 4,784,445 | 11/1988 | Ott | 312/236 |

*Primary Examiner*—Jay H. Woo
*Assistant Examiner*—C. Scott Bushey
*Attorney, Agent, or Firm*—George A. Bode; Michael L. Hoelter

[57] ABSTRACT

An adjustable cabinet having a built-in ventilation and air purification unit for portability and versatility when used in conjunction with modular work stations. The adjustable cabinet can expand and contract in size and be moved as needed for varying storage requirements or furniture arrangements of the work station while still providing ventilation to the work area.

5 Claims, 3 Drawing Sheets

ADJUSTABLE VENTILATION, AIR PURIFICATION AND STORAGE APPARATUS FOR MODULAR OFFICE FURNITURE

BACKGROUND OF THE INVENTION

1. Field of the Invention

The present invention pertains to modular or cluster-type work stations and more particularly to an adjustable ventilation and storage apparatus for use in such work stations.

2. General Background

Modular office work stations have been in existence for some time. These work stations generally consist of a central vertical core supporting a series of radiating partitions that define separate work areas. This central core often contains electrical, communication, and ventilation equipment that is shared by the individual work areas. Other stations provide a raceway to distribute power and communications, but without any ventilation system.

To provide adequate ventilation, some work stations, such as those disclosed in U.S. Pat. No. 4,784,445 issued to D. E. Ott entitled "Heated And Ventilated Work Station" and U.S. Pat. No. 4,378,727 issued to Structural Concepts Corporation on the application of J. A. Doss entitled "Data Station With Wire And Air Duct" disclose a common conduit having a series of vents that correspond to the number of work areas surrounding that conduit. Others, such as U.S. Pat. No. 4,094,256 issued to VOKO Franz Vogt & Co. on the application of M. Holper et al. entitled "Work Table Having Lines Embodied Therein" and U.S. Pat. No. 2,795,471 issued to R. G. Reineman entitled "Furniture Desk" disclose ventilation systems that connect to a desk in the work station. Still others, such as U.S. Pat. No. 2,285,346 issued to J. B. Moncrief entitled "Cabinet Construction", U.S. Pat. No. 3,364,838 issued to G. D. Bradley entitled "Cabinet For Mounting, Enclosing And Cooling Electrical Apparatus" and U.S. Pat. No. 4,014,598 issued to Quantel Limited on the application of A. D. Stalley et al. entitled "Component Cabinet" disclose ventilation cabinets that secure to the partition walls.

In all of these instances, problems occur whenever the modular work station is altered. The "common conduit" group suffers because of the fixed number of existing vents, it being difficult to add new work areas or subtract old ones. The "desk connection" group requires work stations with identical desks, thus hindering the adaptability of modular work stations. The "cabinet" group suffers because the cabinets, being connected to the ventilation system, are unable to easily cope with a change in location (i.e. farther out along a partition wall, lower, higher, etc.).

It is thus an object of this invention to provide a ventilation and air purification system for modular work stations that overcome all of these disadvantages. It is also an object of this invention to provide ventilation and air purification that is easily adjustable while also supplying an additional storage area. A further object of this invention is to provide a ventilation, air purification and storage unit that is adaptable to the needs of the person or persons at each individual work area such that adjacent work areas may utilize the same invention differently. Still another object of this invention is to provide a ventilation, air purification and storage unit that is modular in that it can be moved as desired, or additional units can be added as needed. These and other advantages of this invention will become obvious upon further investigation.

SUMMARY OF THE PRESENT INVENTION

The preferred embodiment of the apparatus of the present invention solves the aforementioned problems in a straight forward and simple manner. What is provided is an adjustable cabinet for providing ventilation, air purification and storage to modular work stations having top, bottom, front and side walls, the back of the cabinet remaining open. The top, bottom and front walls each have end extensions so that their length may be varied as needed. These end extensions are secured together and move in unison via the side walls and a hinge assembly securing the front wall extensions to the top wall extensions. A ventilation and air purification unit is secured underneath the bottom wall intermediate the bottom wall extension and it is configured with a front grill, an internal filter, and a bottom grill for air flow inlet and egress. A source of illumination may be added.

BRIEF DESCRIPTION OF THE DRAWINGS

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
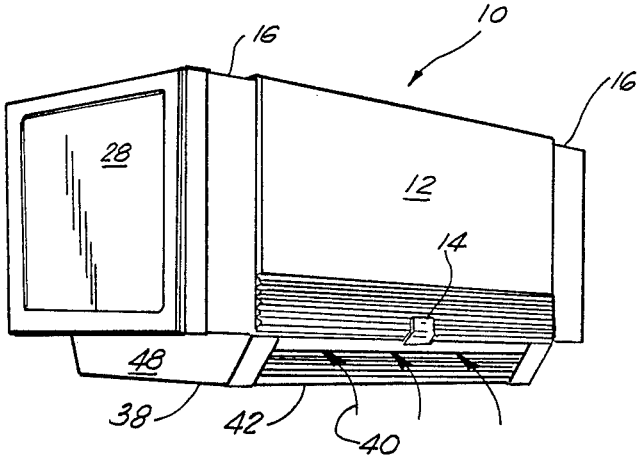
FIG. 1 is a pictorial view of the invention with the front wall in the closed position.
Figure 2:
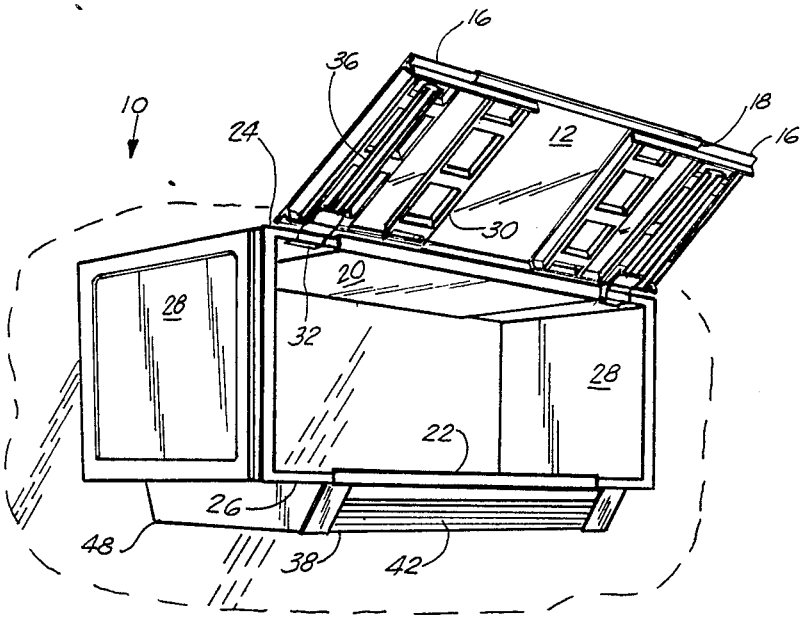
FIG. 2 is a pictorial view of the invention with the front wall pivoted open.
Figure 3:
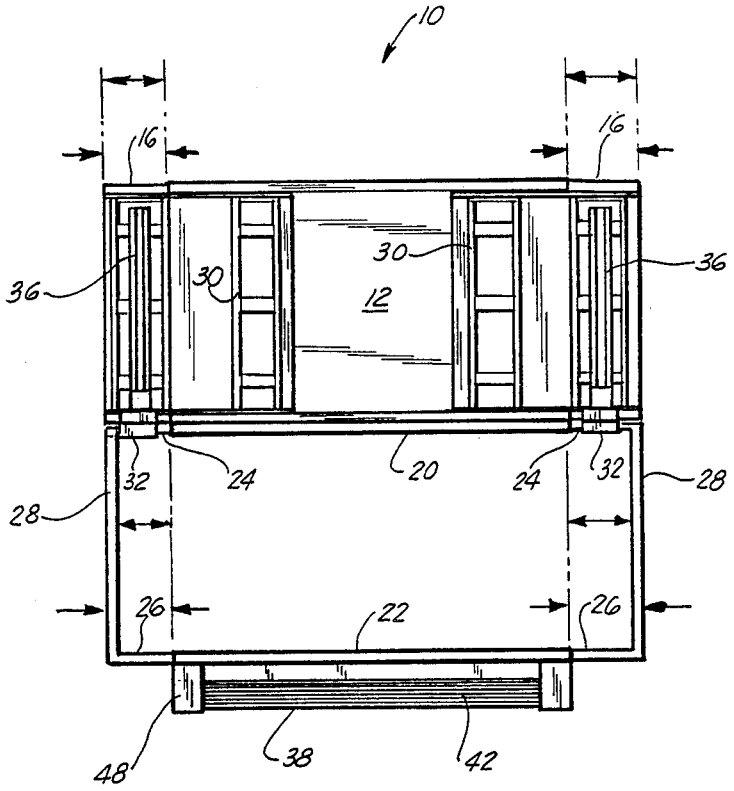
FIG. 3 is a front view of the invention with the front wall pivoted upwards; and, FIG. 4 is an exploded pictorial view of the various components comprising the invention.

Referring now to the drawings, there is shown cabinet 10 as it would appear mounted on a wall or divider of a modular work station. FIG. 1 discloses cabinet 10 with front wall 12 closed by latch 14 while FIGS. 2 and 3 disclose front wall 12 swung open. As can be seen in better detail in FIG. 4, front wall 12 has front wall extensions 16 located on either side. These front wall extensions 16 slide telescopically along tracks or guides 18 positioned along the inside of front wall 12 as shown. As needed, then, the length of front wall 12 can be expanded or contracted by adjusting one or both of side wall extensions 16.

Figure 4:
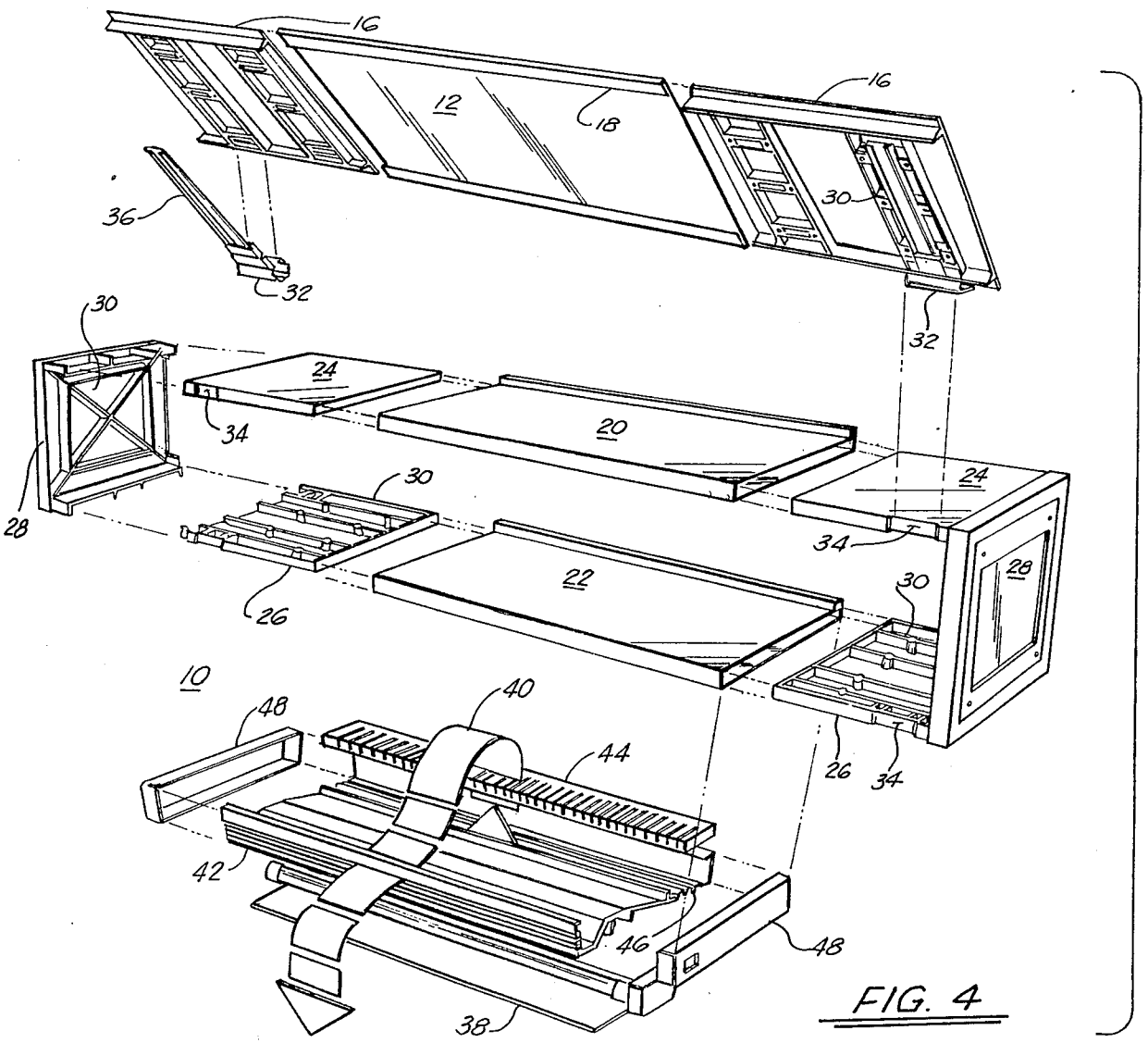

Similarly, top and bottom walls 20 and 22 are equally adjustable via top and bottom wall extensions 24 and 26. In this case, however, top and bottom walls 20 and 22 are hollow (or at least their end regions are hollow) and top and bottom wall extensions 24 and 26 are sized to closely slide telescopically within as shown in FIG. 4.

To complete cabinet 10, side walls 28 are fastened to the outermost end regions of top and bottom wall extensions 24 and 26. The method of fastening may be mechanical or chemical or both, but in any case, each side wall 28 couples its respective top and bottom wall extension 24 and 26 together so that all three move in unison.

Stiffeners 30 are designed into each of extensions 16, 24 and 26 and also side walls 28 to increase their strength and rigidity.

Hinge 32 is secured, as shown, within indentation 34 in the front edge of top wall extension 24. However, hinge 32 may also be secured within identical indentations 34 in the front edge of bottom wall extension 26. Whether hinge 32 swings from top or bottom wall extension 24 or 26, it is also coupled to front wall extension 16. It should be noted that hinge 32 is secured to these extensions adjacent side wall 28 so as to maximize the adjustment of cabinet 10.

While hinge 32 may be of the common variety enabling front wall 12 to pivot either up or down on hinge 32, it is preferred that hinge 32 be on track 36 thereby enabling front wall 12 to pivot itself parallel to top (or bottom) wall 20 and then slide backward on top of (or underneath) this wall so that it is out of the way for access to the interior of cabinet 10.

Underneath cabinet 10 is ventilation and air purification unit 38. It is secured to bottom wall 22 intermediate bottom wall extensions 26. Obviously, when ventilation and air purification unit 38 is secured to cabinet 10, front wall 12 must be hinged to top wall 20 and not to bottom wall 22.

As shown in FIG. 4 by ARROW 40, air would enter ventilation unit 38 via rear grill 46. It would then pass through filter or screen 44 before exiting via front grill 42. End caps 48 are secured to the opposite ends of ventilation unit 38 to prevent any air from deviating from the flow path of ARROW 40. Not shown is a fan or other means of inducing the indicated flow path through ventilation unit 38. (There may be added to unit 38 a source of illumination (not shown) such as a source of electrical power and bulb).

During use, cabinet 10 would be secured to a partition of a modular work station. As needed the size and storage capability of cabinet 10 can vary to accommodate either the needs of the user, the space limitations of the work station, or different partition and/or work station configurations. For example, should cabinet 10 be in the contracted position, it can easily be extended by simply sliding out extensions 16, 24, and 26 along with their respective side wall 28. During this expansion process, hinges 32 would also be slid farther apart while still enabling access to the interior of cabinet 10. When front wall 12 is opened, it would be pivoted approximately ninety (90°) degrees and aligned parallel with top wall 20. Afterwards, front wall 12 would be pushed backward thereby causing hinge 32 to slide along track 36. When front wall 12 is then positioned directly over top wall 20, it will remain stabilized in this position so that unhindered access to cabinet 10 may be realized.

For ventilation purposes, cabinet 10 is self-contained by the inclusion of ventilation unit 38. In this fashion, the size and location of cabinet 10 can vary without the need to redirect or reconnect duct work, control instruments, or the like. This makes cabinet 10 very portable and versatile for use in a variety of situations.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An adjustable component cabinet for providing ventilation, air purification and storage to a modular work station comprising:

(a) a cabinet having top, bottom, front and opposing side walls, a back of said cabinet remaining open;

(b) a pair of top wall extensions slidably and telescopically secured to opposing end regions of said top wall;

(c) a pair of bottom wall extensions slidably and telescopically secured to opposing end regions of said bottom wall;

(d) each of said side walls being secured to a said top wall extension and a said bottom wall extension, said side walls being movable with said extensions; and, (e) a pair of front wall extensions slidably and telescopically secured to opposing end regions of said front wall;

(f) a hinge assembly pivotally securing each of said front wall extensions to its respective said top wall extension thereby enabling said front, top, and bottom wall extensions and their respective side wall to slide in unison;

(g) a lower ventilation and air purification means secured to and underneath said bottom wall intermediate said side walls, said lower ventilation means comprising a front grill, an internal filter and a rear grill for ventilation therethrough.

2. The apparatus of claim 1, wherein said top and bottom walls are hollow and said top and bottom wall extensions slide telescopically therein.

3. The apparatus of claim 2, further comprising guide means secured to said front wall for sliding said front wall extensions with respect to said front wall.

4. The apparatus of claim 3, wherein said guide means comprise a guide along longitudinal edges of said front wall, said guide being configured to enable said front wall extensions to slide telescopically therein.

5. The apparatus of claim 4, wherein said hinge assembly comprises a track configured to enable said front wall to slide with respect to said top wall after said front wall is pivoted open to a position parallel to said top wall.

* * * * *